United States Patent [19]

Deters

[11] Patent Number: 4,553,799

[45] Date of Patent: Nov. 19, 1985

[54] ELECTRICAL CONNECTOR CLIP ASSEMBLY

[76] Inventor: Paul M. Deters, 2105 Harkness St., Manhattan Beach, Calif. 90266

[21] Appl. No.: 512,905

[22] Filed: Jul. 11, 1983

[51] Int. Cl.[4] ..... H01R 31/08

[52] U.S. Cl. ..... 339/19; 339/259 R

[58] Field of Search ..... 339/19, 259 R, 259 F, 339/222

[56] References Cited

U.S. PATENT DOCUMENTS

| | | | |
|---|---|---|---|
| 3,303,293 | 2/1967 | Howell, Jr. | 191/23 |
| 3,335,399 | 8/1967 | Rys | 339/259 F |
| 3,582,864 | 6/1971 | Sullivan | 339/19 |
| 4,351,583 | 9/1982 | Belttary | 339/259 R |

FOREIGN PATENT DOCUMENTS

| | | | |
|---|---|---|---|
| 1140583 | 3/1957 | France | 339/259 F |

*Primary Examiner*—Neil Abrams

*Attorney, Agent, or Firm*—Jack C. Munro

[57] ABSTRACT

An electrical connector assembly which is used to connect between a pair of spaced-apart terminal posts. The electrical connector assembly is formed of a clip section and a removable, springy wire member. The clip section is formed of substantially pure copper thereby having a high degree of electrical conductivity. The clip section is to have a pair of spaced-apart legs, with the terminal posts to be located therebetween. The wire member is to be inserted over the clip section and is to exert a spring bias to continuously maintain the leg members in tight contact with the terminal posts.

1 Claim, 5 Drawing Figures

ELECTRICAL CONNECTOR CLIP ASSEMBLY

BACKGROUND OF THE INVENTION

The field of this invention relates to an electrical connector assembly for establishing an electrically conductive path between two or more closely spaced electrical conducting terminal posts, which are normally arranged in a row.

A simplified definition of a bus, in regard to electronics, is a conductor, or a group of conductors, which serve as a common connection for two or more circuits. The group of conductors normally takes the shape of elongated prong-like members. The prong-like members are attached to a solid base which resembles the shape of a bar, hence the term "bus bar".

Buses can be any given size. A bus bar includes a base, one side of which includes some type of electrical circuitry, such as a printed circuit board. The elongated prong-like members protrude from the opposite side of the base. A single bus bar can utilize two terminal posts or a substantial number of terminal posts. In most instances, the spacing between the directly adjacent terminal posts is identical. Also, terminal posts are arranged in a plurality of rows.

In the past, it has been desirable to design an electrical connection between one terminal post and another. Such electrical connectors have taken numerous forms, such as, for example, a bare wire being wrapped around each terminal post and extending therebetween. Also, numerous types of clips have been previously used.

It would be most desirable to construct such a clip out of a material having the highest electrical conductivity. A desirable type of material would be substantially pure copper. This means that a greater amount of electrical current can be conducted per the cross-sectional area of the electrical connector if substantially pure copper is utilized.

However, pure copper has one primary disadvantage, that being that it has no resiliency. In other words, if pure copper is bent, it will stay in that bent configuration.

In the constructing of an electrical connector between two or more terminal posts, it is common for the clip to include a certain amount of resiliency so that it is continuously biased into tight engagement with the terminal posts so as to maintain a tight electrical connection therebetween. This biasing action is obtained by slightly deforming, or bending, of the clip from its normal at rest position when being connected to the terminal post. The clip, in turn, is biased into tight engagement with the terminal post.

In the past, in order to achieve this desired amount of resiliency, a copper alloy has been employed, rather than pure copper. In the past, a desirable form of copper alloy has been beryllium copper. However, even though a copper alloy is used, the electrical conductivity is substantially diminished from that of pure copper. Beryllium copper has an electrical conductivity of about one-fourth of that of substantially pure copper. This means that a pure copper connector only needs to be one-fourth in cross-sectional size than a beryllium copper connector in order to carry the same electrical current.

In recent years, printed circuit boards and bus bars have become smaller in size. Because of this small size, it is necessary to use small electrical connectors. A substantially smaller electrical connector could be utilized if a substantially pure copper electrical connector is used. Because of the necessary resiliency that is needed, there as been an inherent size limiting factor that was necessary in order to achieve the desired electrical current carrying capability.

SUMMARY OF THE INVENTION

The structure of this invention is directed to an electrical connector assembly which defines a substantially hairpin (in cross-section) shaped clip which is formed of substantially pure copper. The clip is elongated to the desired length and may, in actual practice, be several inches long. Within the apex section of the clip (which connects the parallel spaced-apart legs) there is formed a plurality of spaced-apart holes. A terminal post is to extend between the legs and pass through a said hole. A springy wire member is to be deformed from its at rest position as it is inserted over the exterior surface of the clip member. The springy wire member functions to exert a continuous biasing force against each of the leg members of the clip forcing the inner surface of each of the leg members into tight contact with the terminal posts. There will be utilized a plurality of the wire members with a single wire member to be located about each terminal post.

DETAILED DESCRIPTION OF THE SHOWN EMBODIMENT

Figure 1:
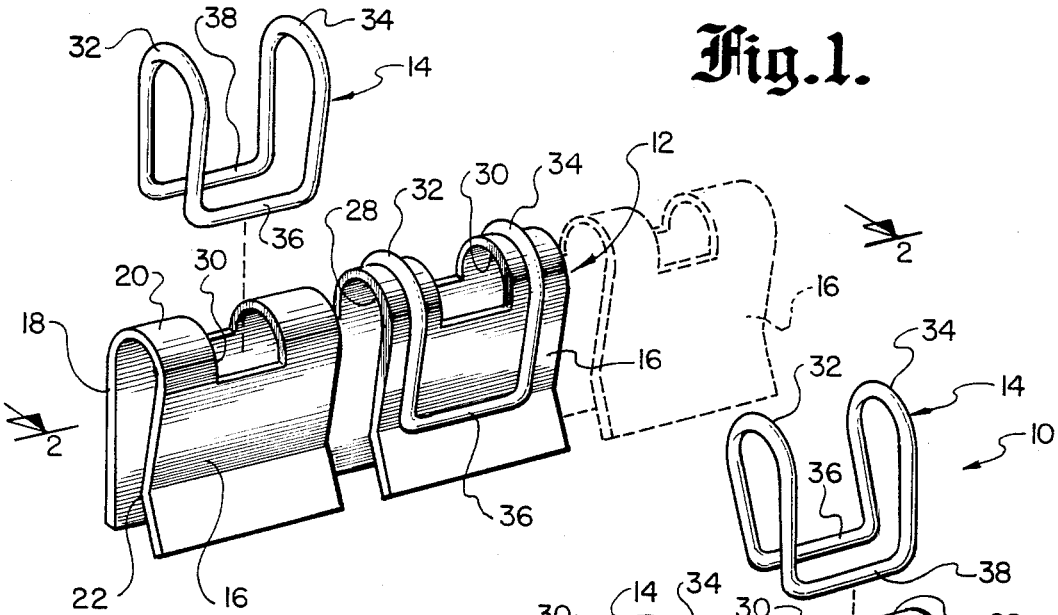
FIG. 1 is a front, isometric view of the electrical connector assembly of this invention showing a first version of wire member which is to be mounted on the exterior surface of the electrically conducting clip.
Figure 2:
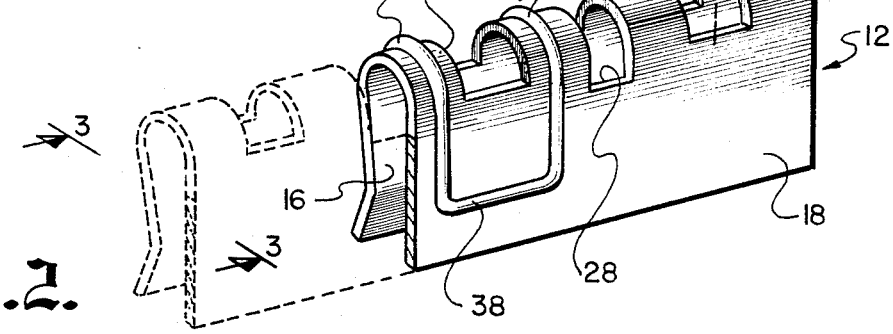
FIG. 2 is a rear isometric view of the electrical connector assembly of this invention taken along line 2—2 of FIG. 1.

Referring particularly to the drawing, there is shown the electrical connector assembly 10 of this invention which is generally constructed of a clip member 12 and a wire member 14. The clip member 12 takes the basic shape of an elongated hairpin. The clip member 12 is constructed of a front leg 16 and a rear leg 18, which are connected together at an apex 20.

The free end section of the leg 16 is bent about bend-line 22 forming an outwardly flared section. This flaring outwardly of the leg 16 facilitates the connection with a terminal post 24, which is mounted on a bus bar base 26. The bend 22 is to abut one side of the terminal post 24. The back leg 18 is substantially planar and the inside planar surface of the leg 18 is to also abut the terminal post 24. The conducting of electricity from one terminal post 24 to another terminal post 24 is through the back leg 18. The front leg 16 is broken into a series of separate sections 16, with there being a slot 28 in between each directly adjacent section 16. The slot 28 also extends through the apex 20. Each individual section of the leg 16 is to connect with a single terminal post 24.

Figure 3:
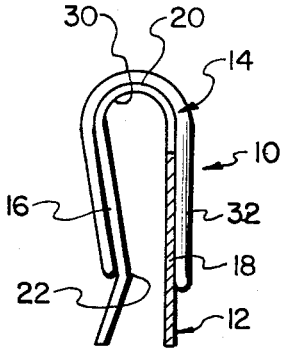
FIG. 3 is an end view of the electrical connector assembly of this invention taken along line 3—3 of FIG. 2 showing the electrical connector unattached to a terminal post.

Within the apex 20 of each leg section of the leg 16, there is formed a hole 30. A terminal post 24 is to extend through the hole 30, such as is shown in FIG. 3 of the drawing.

In order to obtain maximum electrical conductivity, the clip member 12 is constructed entirely of substantially pure copper. However, when pure copper, is bent to a particular configuration, it will remain in that configuration as it has, for all practical purposes, no resiliency or springiness. It is important that the inner surface of the back leg 18 be tightly held in contact with the terminal post 24. The clip member 12, since it has no resiliency or springyness, is not able to be held by itself into tight contact with the terminal post 24.

In order to insure that the clip member 12 is held into tight contact with the post 24, there is to be utilized the separate wire member 14. The wire member 14 is bent to form a pair of substantially U-shaped arms 32 and 34. Aligned ends of the arms 32 and 34 are connected together by means of connecting members 36 and 38. The wire member 14 is to be placed upon the exterior surface of the clip member 16, with there being a separate wire member 14 for each separate section of the clip member 16. The connecting member 36 is to be located directly adjacent the bend 22. The size of the spring member 14 is such that the clip member 12 will assume, when at rest, the solid line position shown in FIG. 3 of the drawing. This at rest position forms a gap between the inner surface of the leg 18 and the bend 22 which is smaller than the width of the terminal post 24. Therefore, locating of the clip member 12 onto the terminal post 24, the clip member 24 will be caused to expand slightly to its dotted line position shown in FIG. 3. This creates a continuous bias which securely holds the clip member 12 in contact with the terminal post 24, thereby maintaining a positive electrical connection therebetween.

Figure 4:
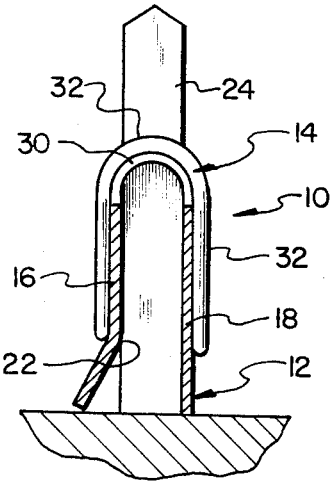
FIG. 4 is a view similar to FIG. 3 but with the electrical connector attached to a terminal post.
Figure 5:
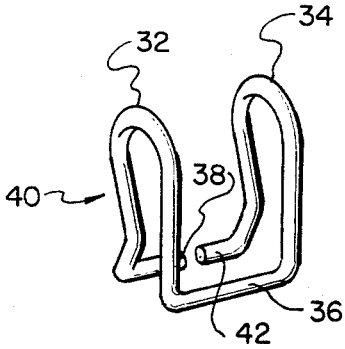
FIG. 5 is an isometric view of a second version of wire member which can be utilized with the electrical conducting clip included within this invention.

Referring particularly to FIG. 4 of the drawing, there is shown a modified version 40 of the wire member 14. Similar numerals have been used to refer to like parts. The distinction between wire member 40 and wire member 14 is that the connecting member 38 includes a cut-out section forming a space 42. This causes the U-shaped members 32 and 34 to act independently of each other when being placed upon the clip member 12. The space 42 would be desirable for certain configurations of clip members which are not shown.

What is claimed is:

1. In combination with a plurality of elongated spaced-apart terminal posts, an electrical connector assembly for electrically connecting at least one said terminal post to another said terminal post, said electrical connector assembly comprising:

an elongated electrical conducting clip member defining in lateral cross-section a pair of spaced-apart leg members, said leg members having facing inner surfaces, a gap located between said facing inner surfaces, an apex section, said leg members being attached to said apex section, said apex section including a plurality of spaced-apart holes, a said terminal post to extend through a said hole with said facing inner surfaces being in contact with said terminal posts, said clip member being constructed of substantially pure copper thereby having a high electrical conductivity but lacking in resiliency to be biased into tight engagement with said terminal posts; and means connected to said clip member for exerting a continuous bias against said leg members forcing said leg members into tight engagement with said terminal posts, said means being removably connected to said clip member, said means comprising a continuous wire member, said wire member defining a pair of U-shaped members located in a spaced-apart relationship, each said U-shaped member having a pair of substantially parallel arms, the outer end of one said arm of one said wire member being connected by a first connecting member to the outer end of an arm of the other said U-shaped wire member, the outer end of the remaining said arm of said one U-shaped wire member being connected by a second connecting member to the outer end of the remaining said arm of said the other said U-shaped wire member, said first connecting member being parallel to said second connecting member, said first connecting member to be in contact with one said leg member with the other said connecting member being in contact with the other said leg member with each said U-shaped member being located on a different side of one of said holes.

* * * * *